US009611123B1

(12) United States Patent
Martelli

(10) Patent No.: US 9,611,123 B1
(45) Date of Patent: Apr. 4, 2017

(54) QUICK SPINNER THREAD ALIGNMENT APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 220 days.

(21) Appl. No.: 14/623,745

(22) Filed: Feb. 17, 2015

Related U.S. Application Data

(60) Provisional application No. 61/941,212, filed on Feb. 18, 2014.

(51) Int. Cl.

| | |
|---|---|
| ***B65H 49/26*** | (2006.01) |
| ***B65H 49/28*** | (2006.01) |
| ***B65H 49/32*** | (2006.01) |
| ***B65H 57/04*** | (2006.01) |
| ***D05B 43/00*** | (2006.01) |

(52) U.S. Cl.
CPC ..... *B65H 49/26* (2013.01); *B65H 49/28* (2013.01); *B65H 49/324* (2013.01); *B65H 57/04* (2013.01); *D05B 43/00* (2013.01)

(58) Field of Classification Search
CPC ..... B65H 49/26; B65H 49/28; B65H 49/324; B65H 57/04; D05B 43/00
See application file for complete search history.

(56) References Cited

U.S. PATENT DOCUMENTS

2006/0150880 A1* 7/2006 Prufer ..... D05B 43/00
112/302

* cited by examiner

*Primary Examiner* — William E Dondero
(74) *Attorney, Agent, or Firm* — J. Nevin Shaffer, Jr.

(57) ABSTRACT

A quick spinner thread alignment apparatus consists of a two part adjustable mounting block comprised of an upper block and a lower block. An angle adjustment device is connected to the upper block and the lower block where the angle adjustment device adjustably secures the upper block at selected angles relative to the lower block. A thread support disk is rotatably connected with the mounting block. A thread saver is connected with the mounting block. A thread pole is connected with the thread support disk and a brake is connected with the thread support disk and the mounting block.

20 Claims, 2 Drawing Sheets

QUICK SPINNER THREAD ALIGNMENT APPARATUS AND METHOD

CROSS REFERENCE TO RELATED APPLICATION

This application claims the benefit of previously filed U.S. provisional patent application No. 61/941,212 filed Feb. 18, 2014 for a "Quick Spinner Thread Alignment Apparatus and Method". The Applicant hereby claims the benefit of this provisional application under 35 U.S.C. §119. The entire content of this provisional application is incorporated herein by this reference.

FIELD OF THE INVENTION

This invention relates to a quick spinner thread alignment apparatus and method. In particular, in accordance with one embodiment, the invention relates to a quick spinner thread alignment apparatus consisting of a two part adjustable mounting block comprised of an upper block and a lower block. An angle adjustment device is connected to the upper block and the lower block where the angle adjustment device adjustably secures the upper block at selected angles relative to the lower block. A thread support disk is rotatably connected with the mounting block. A thread saver is connected with the mounting block. A thread pole is connected with the thread support disk and a brake is connected with the thread support disk and the mounting block.

BACKGROUND OF THE INVENTION

A problem exists with regard to the use of sewing and quilting machines. In use the machines require thread to be fed to an eyelet on the sewing machine. In larger machines it is common for the thread to be loaded on thread cones and the thread pulled off of the thread cone into the eyelet. The problem is that when the thread comes off of the thread cone, if it is not perpendicular to the thread cone, or nearly so, the thread will catch and kink and oftentimes break.

Thus, there is a need in the art for a thread alignment device that is adjustable such that thread leaving a thread spool can be directed perpendicular to the eyelet from multiple positions. There is also a need for such a device that prevents thread from kinking or getting caught in the device or with the machine it is used with.

It therefore is an object of this invention to provide a thread alignment device that supports a thread spool with thread in close proximity to a sewing machine eyelet that is adjustable so that the thread leaves the thread spool perpendicular to the thread spool on its way to the eyelet. Further it is an objective to provide a device that is freely and quickly spinning to enable the thread to be taken up as quickly as needed but that prevents over spinning of the thread spool and entanglement of the thread with it or other devices.

Therefore, according to one embodiment of the present invention a quick spinner thread alignment apparatus includes a two part adjustable mounting block comprised of an upper block and a lower block. An angle adjustment device is connected to the upper block and the lower block where the angle adjustment device adjustably secures the upper block at selected angles relative to the lower block. A thread support disk is rotatably connected with the mounting block. A thread saver is connected with the mounting block.

A thread pole is connected with the thread support disk and a brake is connected with the thread support disk and the mounting block.

In one aspect, the upper block is angled upward from the lower block and in another aspect the upper block is angled downward toward the lower block.

In another aspect, the thread saver includes a thread stop. In a further aspect, the thread saver is 'U' shaped with a pair of arms where the pair of arms extend upwardly and apart from a common bottom and where the common bottom forms a thread stop.

In one aspect, the brake is connected between the thread support disk and the upper mounting block. In another aspect, the brake is a spring.

In a further aspect, the angle adjustment device includes a slide with a first end and a second end and a slot in between the first end and the second end. In another aspect, the first end is connected with the upper block and the second end is connected with the lower block such that the connection with the lower block is through the slot.

In one aspect, the invention further includes a magnet connected with the quick spinner thread alignment apparatus where the magnet is connectable with other devices.

According to another embodiment, a quick spinner thread alignment apparatus consists of a two part adjustable mounting block comprised of an upper block with a front and a back and a lower block with a front and a back. An angle adjustment device is connected to the back of the upper block and the lower block where the angle adjustment device adjustably secures the upper block at selected angles relative to the lower block and where the angle adjustment device includes a slide with a first end and a second end and a slot in between the first end and the second end. A thread support disk is rotatably connected with the mounting block. A forked thread saver, with a pair of spaced apart arms, is connected with the front of the upper block. A thread pole is connected with the thread support disk and a brake is connected with the thread support disk and the mounting block.

In one aspect, the forked thread saver includes a thread stop. In another aspect, the forked thread saver is 'U' shaped where the pair of arms extend upwardly and apart from a common bottom and where the common bottom forms a thread stop and where the thread stop is located above the thread support disk.

In another aspect, the brake is connected between the thread support disk and the upper mounting block and in one aspect the brake is a spring.

In a further aspect of this embodiment, the first end of the slide is connected with the upper block and the second end is connected with the lower block such that the connection with the lower block is through the slot.

In one aspect, the front of the upper block is angled upward from the front of the lower block and in another aspect, the front of the upper block is angled downward toward the front of the lower block.

According to another embodiment, a quick spinner thread alignment method consists of:

a. providing a two part adjustable mounting block comprised of an upper block and a lower block; an angle adjustment device connected to the upper block and the lower block where the angle adjustment device adjustably secures the upper block at selected angles relative to the lower block; a thread support disk rotatably connected with the mounting block; a thread saver connected with the mounting block; a thread pole connected with the thread support disk; and a brake connected with the thread support disk and the mounting block; and b. connecting a thread cone with thread with the thread pole.

In another aspect, the method further includes adjusting the angle adjustment device and securing it in place such that thread from the thread spool feeds perpendicularly off of the thread spool past the thread saver and perpendicular to an eyelet of a sewing machine.

DESCRIPTION OF THE DRAWINGS

Other objects, features and advantages of the present invention will become more fully apparent from the following detailed description of the preferred embodiment, the claims, and the accompanying drawings in which:

DETAILED DESCRIPTION OF THE INVENTION

Figure 1:
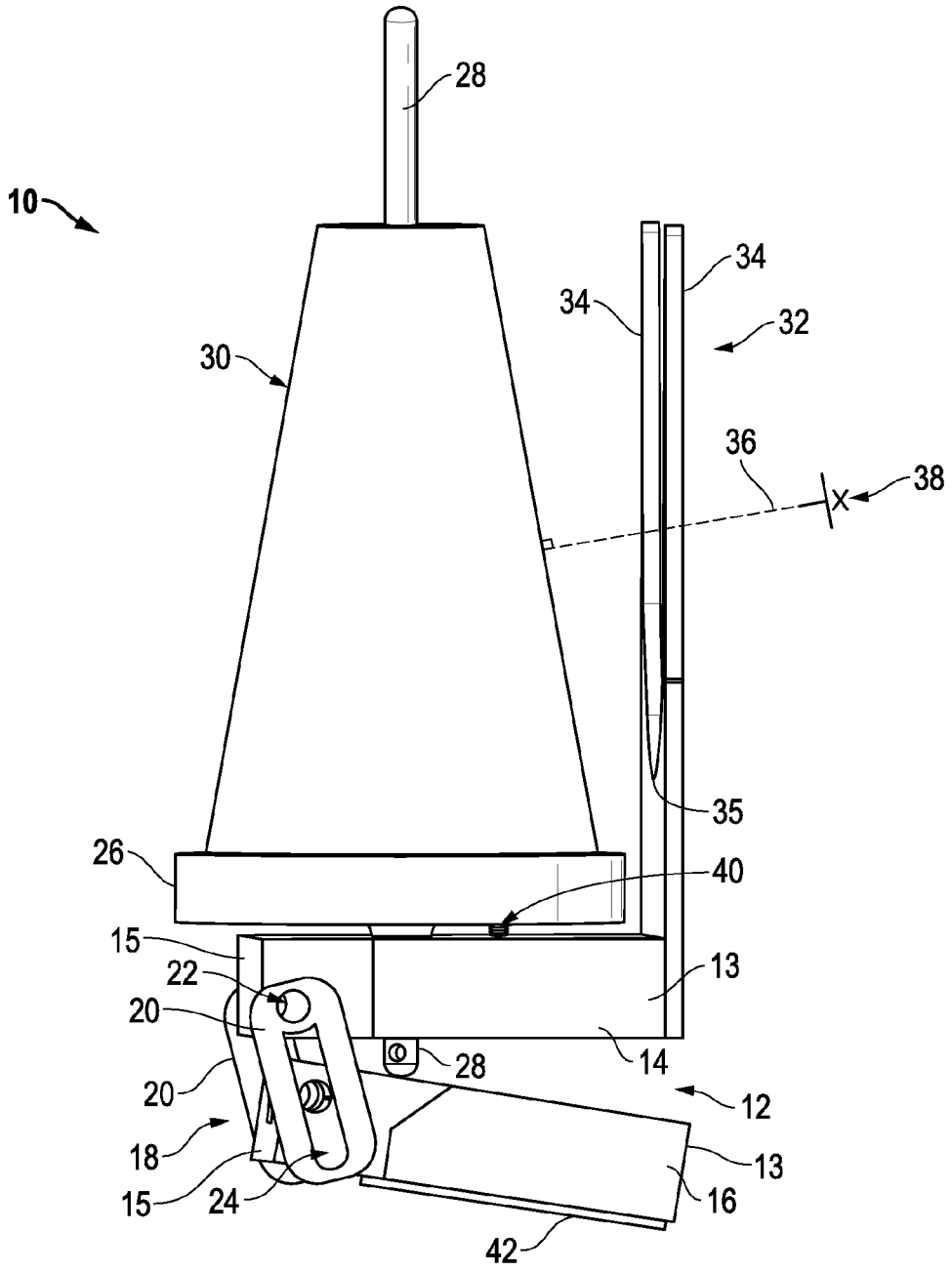
FIG. 1 is a side view of the quick spinner thread alignment apparatus shown in the up angle.
Figure 2:
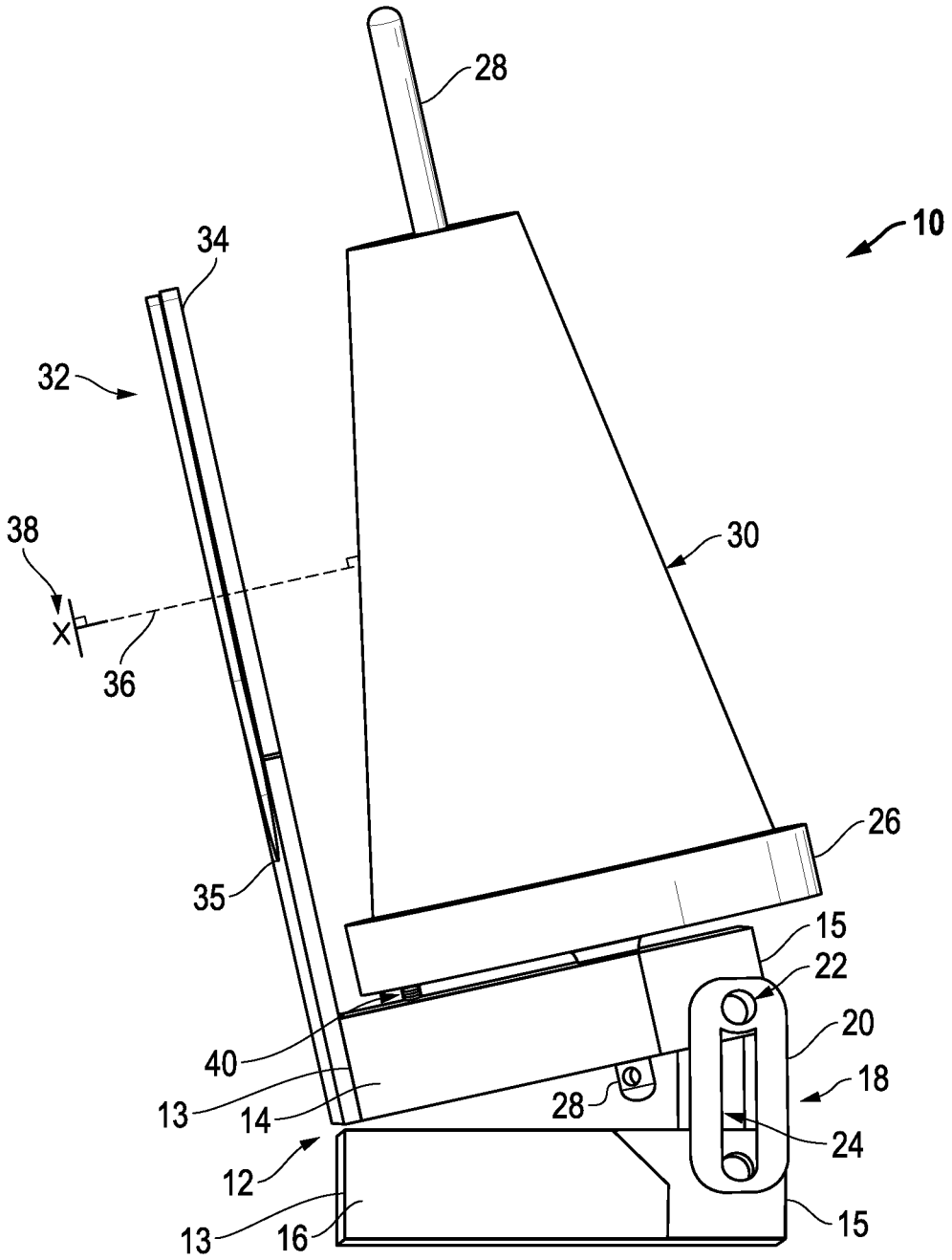
FIG. 2 is a side view of the opposite side of the invention of FIG. 1 shown in the down angle.

The preferred embodiment of the present invention is illustrated by way of example in FIGS. 1-2. With specific reference to FIG. 1, the quick spinner thread alignment apparatus 10 of the present invention includes a two part adjustable mounting block 12. Two part adjustable mounting block 12 includes upper block 14 with a front 13 and a back 15 and lower block 16 also with a front 13 and a back 15. Upper block 14 is connected with lower block 16 by angle adjustment device 18. In one embodiment, angle adjustment device 18 is slide 20, or a pair of slides 20 as shown, with one end 22 secured to the back 15 of upper block 14, for example only, by a screw or the like (not shown). End 22 does not move up and down but may rotate when the screw is loosened. Slide 20 includes slot 24 into which another screw (not shown) is located and then that screw tightened into connection with the back 15 of lower block 16. FIG. 1 shows angle adjustment device 18 adjusted such that the mounting block 12 is "angled up" as will be discussed more fully hereafter. That is, the front 13 of upper block 14 is angled upward and away from the front 13 of lower block 16. Once the proper angle is determined for a particular situation, the screws (not shown) are tightened and the mounting block 12 is held in place.

A thread support disk 26 is rotatably connected with the mounting block 12. By "rotatably connected" a disk that revolves is described. The mechanism for rotation is a matter of choice including bearings and the like. The thread support disk 26 freely revolves and rotates as thread 36 is pulled off of thread cone 30. Thread support disk 26 supports thread cone pole 28 and rotates around with thread cone pole 28. Thread cone pole 28 is secured to thread support disk 26 and holds thread cone 30 when thread cone 30 is placed onto thread cone pole 28 as shown.

A thread saver 32 is connected to upper block 14 on the end of upper block 14 opposite from the end 22 of slide 20. In the Figures, thread saver 32 is connected to the front 13 of upper block 14. In one embodiment, thread saver 32 is forked and includes a pair of upstanding and spaced apart arms or forks 34 through which thread 36 passes on its way from thread cone 30 to an eyelet 38 represented by an "X" on a sewing machine (not shown).

Thread saver 32 keeps thread 36 from becoming entangled with any part of the device. In particular, thread saver 32 supports thread 36 above the rotating thread support disk 26 and keeps the thread easily accessible during and in between uses. In this regard, forked thread saver 32 includes a thread stop 35. In this case, thread stop 35 is the bottom of the "U" shaped forked thread saver 32 where the two forks 34 meet. Certainly, the invention includes the embodiment where the two forks 34 do not connect at the bottom and the thread stop 35 is a bar extending between the two forks 34. Importantly, the thread stop 35 is located above rotating support disc 26.

A brake 40 is connected between the thread support disk 26 and the upper block 14 of mounting block 12. In one embodiment, brake 40 is, for example, a spring that exerts outward pressure onto thread support disk 26. This pressure is slight so that thread support disk 26 freely rotates as the thread 36 is drawn off of thread cone 30. However, this pressure by brake 40 is sufficient to prevent thread support disk 26 from continuing to rotate once thread is no longer being pulled off. Likewise, in the event the thread 36 breaks, the pressure of brake 40 stops the rotation. Thus, brake 40 may be a spring as shown or any other device that applies some resistance to rotation of support disk 26.

FIG. 1 shows how the device is angled in the "up" position to an eyelet 38. The preferred position that is achievable by use of the present invention is for the thread 36 to leave the thread cone 30 perpendicular to the thread cone 30 and aimed directly at eyelet 38 such that ii is received at eyelet 38 perpendicular to eyelet 38 as shown. The term "perpendicular" is given its ordinary meaning s yet it is understood that the term includes angles that are nearly perpendicular as well. It is understood that as the thread 36 is pulled off of thread cone 30, it moves up and down the thread cone 30 and the angle will vary from perpendicular to the eyelet 38 to nearly perpendicular. Nonetheless, the present invention greatly improves the performance of the device as a result of its ability to align the thread 36 directly with the eyelet 38. That is, by use of angle adjustment device 18, the thread cone 30 is positioned such that the thread 36 is aimed directly at eyelet 38, such that the thread 36 leaves the thread cone 30 perpendicular to the thread cone 30 and arrives perpendicular to eyelet 38, and then secured in place.

In many cases it is difficult to secure a position of a device close to the eyelet 38. Most of the sewing devices and machines are made of metal. In such a case, magnets 42 are connected to the bottom of lower block 16 and in this way quick spinner thread alignment apparatus 10 may be securely located close to the eyelet 38 and then adjusted.

Referring now to FIG. 2, the same numbers identify the same elements as in FIG. 1. FIG. 2 however, shows how by loosening screws (not shown) in angle adjustment device 18 slide(s) 20 can be used to extend the back 15 of upper block 14 away from the back 15 of lower block 16 such that the front 13 of upper block 14 can be tilted down toward the front 13 of lower block 16 in the case the eyelet 38 is below the device. This adjustment ability enables the user to position thread cone 30 at the preferred right angle such that the thread 36 directly to eyelet 38, as illustrated, no matter where eyelet 38 is located.

By way of continued description, by comparing FIG. 1 with FIG. 2 it is understood that angle adjustment device 18 allows upper block 14 and lower block 16 to be moved relative to each other along slot 24 in slide 20. In FIG. 1, the backs 15 of upper block 14 and lower block 16 at the angle adjustment device 18 are slightly spaced apart sufficient to allow the front 13 of upper block 14 to be angled upward away from the front 13 of lower block 16 and toward eyelet 38. When eyelet 38 is below the mounting block 12, the backs 15 of upper block 14 and lower block 16 are spaced far apart at opposite ends of slot 24 thereby allowing the front 13 of upper block 14 to angle down toward the front 12 of lower block 16 and toward eyelet 38, as shown. In this regard, in one embodiment, the end of slide 20 connected with upper block 14 is not connected with slot 24. As shown in the figures, the end of slide 20 connected with upper block 14 includes an opening, hole, through which a screw (not shown for clarity) is inserted. The screw can be tightened and un-tightened to allow upper block 14 to rotate and be secured in place at the desired angle but it does not otherwise move. At the other end of slide 20, lower block 16 is connected with a screw (not shown) through slot 24. When it is desired to angle the upper and lower blocks, the screw is loosened and then slides within slot 24 until the desired angle is reached and then tightened in place.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the following claims of the invention.

What is claimed is:

1. A quick spinner thread alignment apparatus comprising:

a. a two part adjustable mounting block comprised of an upper block and a lower block;

b. an angle adjustment device connected to said upper block and said lower block wherein said angle adjustment device adjustably secures said upper block at selected angles relative to said lower block;

c. a thread support disk rotatably connected with the mounting block;

d. a thread saver connected with the mounting block;

e. a thread pole connected with the thread support disk; and f. a brake connected with the thread support disk and the mounting block.

2. The apparatus of claim 1 wherein said upper block is angled upward from said lower block.

3. The apparatus of claim 1 wherein said upper block is angled downward toward said lower block.

4. The apparatus of claim 1 wherein said thread saver includes a thread stop.

5. The apparatus of claim 1 wherein said thread saver is 'U' shaped with a pair of arms and wherein said pair of arms extend upwardly and apart from a common bottom and wherein said common bottom forms a thread stop.

6. The apparatus of claim 1 wherein said brake is connected between said thread support disk and said upper mounting block.

7. The apparatus of claim 1 wherein said brake is a spring.

8. The apparatus of claim 1 wherein said angle adjustment device includes a slide with a first end and a second end and a slot in between said first end and said second end.

9. The apparatus of claim 8 wherein said first end is connected with the upper block and said second end is connected with said lower block such that the connection with the lower block is through said slot.

10. The apparatus of claim 1 further including a magnet connected with said quick spinner thread alignment apparatus and wherein said magnet is connectable with other devices.

11. A quick spinner thread alignment apparatus comprising:

a. a two part adjustable mounting block comprised of an upper block with a front and a back and a lower block with a front and a back;

b. an angle adjustment device connected to the back of said upper block and said lower block wherein said angle adjustment device adjustably secures said upper block at selected angles relative to said lower block wherein said angle adjustment device includes a slide with a first end and a second end and a slot in between said first end and said second end;

c. a thread support disk rotatably connected with the mounting block;

d. a forked thread saver, with a pair of spaced apart arms, connected with the front of said upper block;

e. a thread pole connected with the thread support disk; and f. a brake connected with the thread support disk and the mounting block.

12. The apparatus of claim 11 wherein said forked thread saver includes a thread stop.

13. The apparatus of claim 11 wherein said forked thread saver is 'U' shaped wherein said pair of arms extend upwardly and apart from a common bottom and wherein said common bottom forms a thread stop wherein said thread stop is located above said thread support disk.

14. The apparatus of claim 11 wherein said brake is connected between said thread support disk and said upper mounting block.

15. The apparatus of claim 11 wherein said brake is a spring.

16. The apparatus of claim 11 wherein said first end of said slide is connected with the upper block and said second end is connected with said lower block such that the connection with the lower block is through said slot.

17. The apparatus of claim 11 wherein the front of said upper block is angled upward from said front of said lower block.

18. The apparatus of claim 11 wherein the front of said upper block is angled downward toward the front of said lower block.

19. A quick spinner thread alignment method comprising:

a. providing a two part adjustable mounting block comprised of an upper block and a lower block; an angle adjustment device connected to said upper block and said lower block wherein said angle adjustment device adjustably secures said upper block at selected angles relative to said lower block; a thread support disk rotatably connected with the mounting block; a thread saver connected with the mounting block; a thread pole connected with the thread support disk; and a brake connected with the thread support disk and the mounting block; and b. connecting a thread cone with thread with said thread pole.

20. The method of claim 19 further including adjusting said angle adjustment device and securing it in place such that thread from said thread spool feeds perpendicularly off of said thread spool past said thread saver and perpendicular to an eyelet of a sewing machine.

* * * * *